US007436274B2

(12) United States Patent
Shih

(10) Patent No.: US 7,436,274 B2
(45) Date of Patent: Oct. 14, 2008

(54) BAND-PASS FILTER

(75) Inventor: Yen-Yi Shih, Shenzhen (CN)

(73) Assignee: Hon Hai Precision Indsutry Co., Ltd., Tu-Cheng, Taipei Hsien (TW)

( * ) Notice: Subject to any disclaimer, the term of this patent is extended or adjusted under 35 U.S.C. 154(b) by 173 days.

(21) Appl. No.: 11/309,627

(22) Filed: Sep. 1, 2006

(65) Prior Publication Data

US 2007/0090900 A1 Apr. 26, 2007

(30) Foreign Application Priority Data

Oct. 21, 2005 (TW) ..... 94137006 A

(51) Int. Cl.
*H01P 3/08* (2006.01)

(52) U.S. Cl. ..... 333/204; 333/175

(58) Field of Classification Search ..... 333/134, 333/175, 176, 202–204
See application file for complete search history.

(56) References Cited

U.S. PATENT DOCUMENTS

| | | | | |
|---|---|---|---|---|
| 5,955,931 | A | 9/1999 | Kaneko et al. | |
| 6,326,866 | B1 * | 12/2001 | Sasaki et al. | 333/203 |
| 6,823,201 | B2 | 11/2004 | Kai et al. | |
| 7,262,677 | B2 * | 8/2007 | Kubota et al. | 333/204 |

* cited by examiner

*Primary Examiner*—Don P Le
(74) *Attorney, Agent, or Firm*—Wei Te Chung

(57) ABSTRACT

A band-pass filter (10) for reducing harmonic electromagnetic signals includes an input line (100), an output line (120), at least one first resonator (140), and at least one second resonator (160). The input line inputs electromagnetic signals. The output line outputs electromagnetic signals. The first resonator includes a first grounded end (141), electronically connected to the input line, and a first open end (142). The second resonator is disposed parallel to the first resonator. The second resonator includes a second grounded end (161), electronically connected to the output line, and a second open end (162). The first grounded end is disposed in the same direction as the second grounded end, and the first open end is disposed in the same direction as the second open end.

20 Claims, 4 Drawing Sheets

BAND-PASS FILTER

DESCRIPTION

1. Field of the Invention

The present invention generally relates to filters, and more particularly to a band-pass filter.

2. Related Art

In recent years, there has been a significant growth in wireless local network (WLAN) technology due to the ever growing demands of wireless communication products. Such growth becomes particularly prominent after promulgation of IEEE 802.11 WLAN protocol in 1997. IEEE 802.11 WLAN protocol not only offers many novel features to current wireless communications, but also provides a solution of enabling two wireless communication products manufactured by different companies to communicate with each other. The promulgation of IEEE 802.11 WLAN protocol is a milestone in the development of WLAN. Moreover, IEEE 802.11 WLAN protocol ensures that a core device is the only solution of implementing a single chip. Thus, IEEE 802.11 WLAN protocol can significantly reduce the cost of adopting wireless technology so as to enable WLAN to be widely employed in various wireless communication products.

Conventionally, electromagnetic signals are generated when a wireless communication product, such as an access point complying with IEEE 802.11 WLAN protocol, transfers data via high power, these electromagnetic signals may cause electromagnetic interference (EMI).

For solving the above problem, some manufacturers in the art use a waveguide element, such as a microstrip, to act as a filter. The microstrip filter is formed on a printed circuit board to diminish harmonic electromagnetic signals and to pass an EMI test conducted on a wireless communication product. This is particularly true for electromagnetic signals having second, third, fourth or more harmonics of a fundamental frequency. A well-designed microstrip filter is therefore needed for IEEE 802.11 WLAN protocol products.

Therefore, a heretofore unaddressed need exists in the industry to overcome the aforementioned deficiencies and inadequacies.

SUMMARY OF THE INVENTION

A band-pass filter includes an input line, an output line, at least one first resonator, and at least one second resonator. The input line inputs electromagnetic signals. The output line outputs the electromagnetic signals. The first resonator includes a first grounded end, electronically connected to the input line, and a first open end. The second resonator is disposed parallel to the first resonator. The second resonator includes a second grounded end, electronically connected to the output line, and a second open end. The first grounded end is disposed in the same direction as the second grounded end, and the first open end is disposed in the same direction as the second open end.

Other objectives, advantages and novel features of the present invention will be drawn from the following detailed description of preferred embodiments of the present invention with the attached drawings, in which:

DETAILED DESCRIPTION OF THE INVENTION

Figure 1:
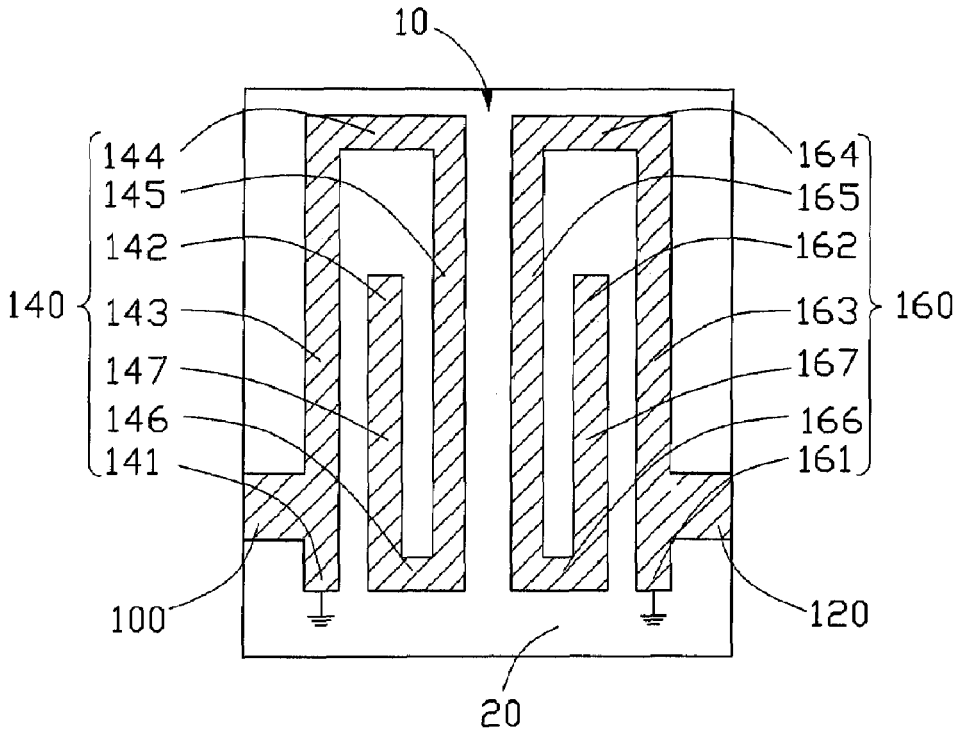
FIG. 1 is a schematic diagram of a band-pass filter of an exemplary embodiment of the invention.

FIG. 1 is a schematic diagram of a band-pass filter 10 of an exemplary embodiment of the present invention.

The band-pass filter 10, printed on a substrate 20, is used for reducing harmonic electromagnetic signals. The band-pass filter 10 includes an input line 100, an output line 120, a first resonator 140, and a second resonator 160.

The input line 100 inputs electromagnetic signals. The output line 120 outputs the electromagnetic signals and is symmetrical to the input line 100. In this embodiment, the input line 100 and the output line 120 have impedance values of approximately 50 ohms.

The first resonator 140 includes a first grounded end 141, electronically connected to the input line 100, a first open end 142, a first external portion 143, a first connecting portion 144, a first coupling portion 145, a second connecting portion 146, and a first internal portion 147. The first coupling portion 145 is disposed parallel to the first external portion 143. The first connecting portion 144 is perpendicular to the first external portion 143 and the first coupling portion 145. The first internal portion 147 is disposed parallel to the first external portion 143 and the first coupling portion 145. The second connecting portion 146 is perpendicular to the first internal portion 147 and the first coupling portion 145, and connects the first internal portion 147 and the first coupling portion 145. The first open end 142 is a free end of the first internal portion 147, and the first grounded end is a free end of the first external portion 143. A length of the first external portion 143 is substantially the same as that of the first coupling portion 145. The input line 100 is electronically connected to the first external portion 143.

The second resonator 160 is disposed parallel to the first resonator 140 with shape, width, and length substantially the same as those of the first resonator 140. The second resonator 160 includes a second grounded end 161, electronically connected to the output line 120, and a second open end 162. The second grounded end 161 is disposed in the same direction as the first grounded end 141, and the second open end 162 is disposed in the same direction as the first open end 142.

The second resonator 160 further includes a second external portion 163, a third connecting portion 164, a second coupling portion 165, a fourth connecting portion 166, and a second internal portion 167. The second coupling portion 165 is disposed parallel to the second external portion 163 in the vicinity of the first coupling portion 145. The third connecting portion 164 is perpendicular to the second external portion 163 and the second coupling portion 165 and connects the second external portion 163 and the second coupling portion 165. The second internal portion 167 is disposed between the second external portion 163 and the second coupling portion 165. The fourth connecting portion 166 is perpendicular to the second internal portion 167 and the second coupling portion 165 and connects the internal portion 167 and the second coupling portion 165. The second open end 162 is a free end of the second internal portion 167, and the second grounded end 161 is a free end of the second external portion 163. The length of the second external portion 163 is substantially the same as the second coupling portion 165. The output line 120 is electronically connected to the second external portion 163.

In this embodiment, lengths of the input line 120 and the output line 140 are randomly selected, and widths thereof are approximately 0.53 mm. An overall length of the transmission line 160 is approximately 11.2 mm, and a width thereof is approximately 0.3 mm. A length of the first coupling line 180 is approximately 5.6 mm, and a width thereof is approximately 1.15 mm. A length of the second coupling line 190 is approximately 5.6 mm, and a width thereof is approximately 1.15 mm. An overall area of the band-pass filter 10 is approximately 24.7 mm2.

Figure 2:
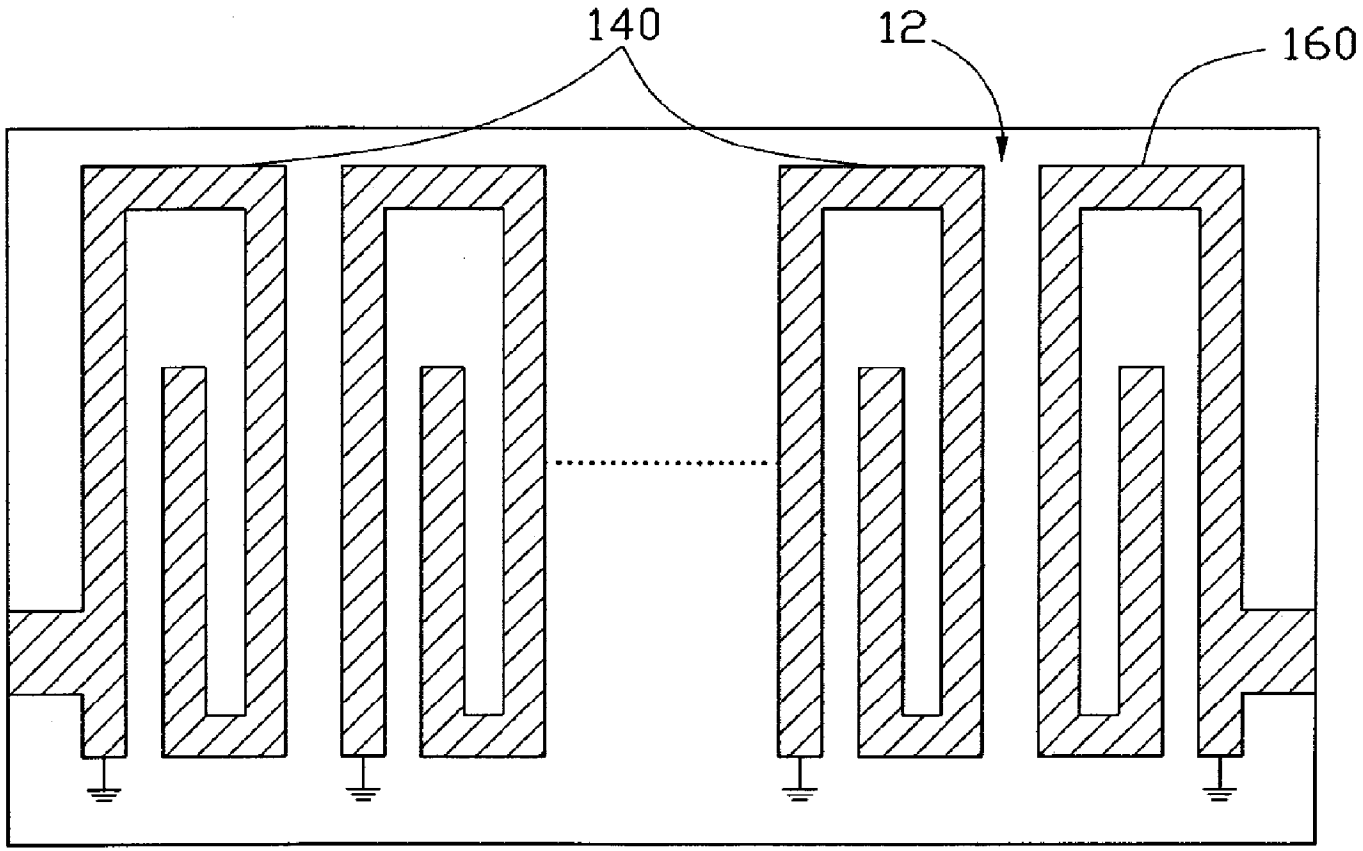
FIG. 2 is a schematic diagram of the band-pass filter of another exemplary embodiment of the invention.

FIG. 2 is a schematic diagram of the band-pass filter 12 of another exemplary embodiment of the invention.

In this embodiment, the band-pass filter 12 includes a plurality of the first resonators 140 parallel to the second resonator 160. The structures of the first resonators 140 and the second resonator 160 are the same as those of FIG. 1, and thus, further descriptions are omitted. The embodiment doest not limit the number of the first resonators 140. Generally, the more resonators are used, the better performance can be obtained.

Figure 3:
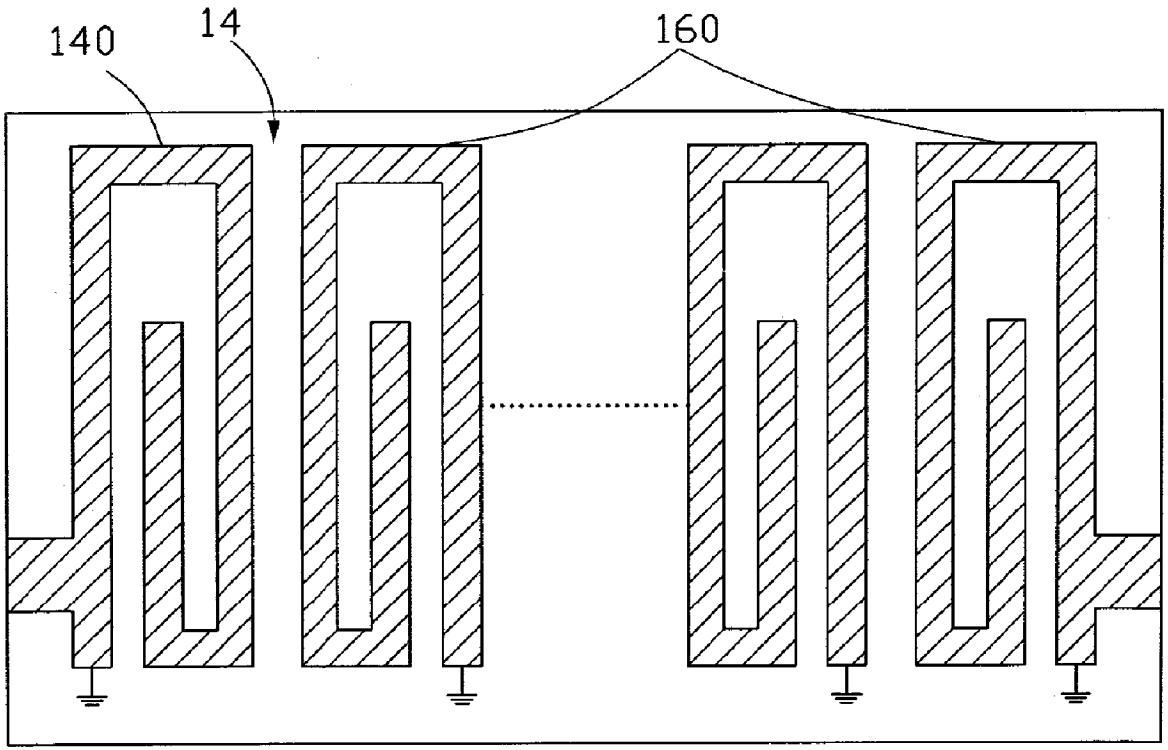
FIG. 3 is a schematic diagram of the band-pass filter of yet another embodiment of the invention.

FIG. 3 is a schematic diagram of the band-pass filter 14 of yet another exemplary embodiment of the invention.

In this embodiment, the band-pass filter 14 includes a plurality of the second resonators 160 parallel to the first resonator 140. The structures of the first resonator 140 and the second resonators 160 are the same as those of FIG. 1, and thus, further descriptions are omitted. The embodiment doest not limit the number of the second resonators 160. Generally, the more resonators are used, the better performance can be obtained.

Figure 4:
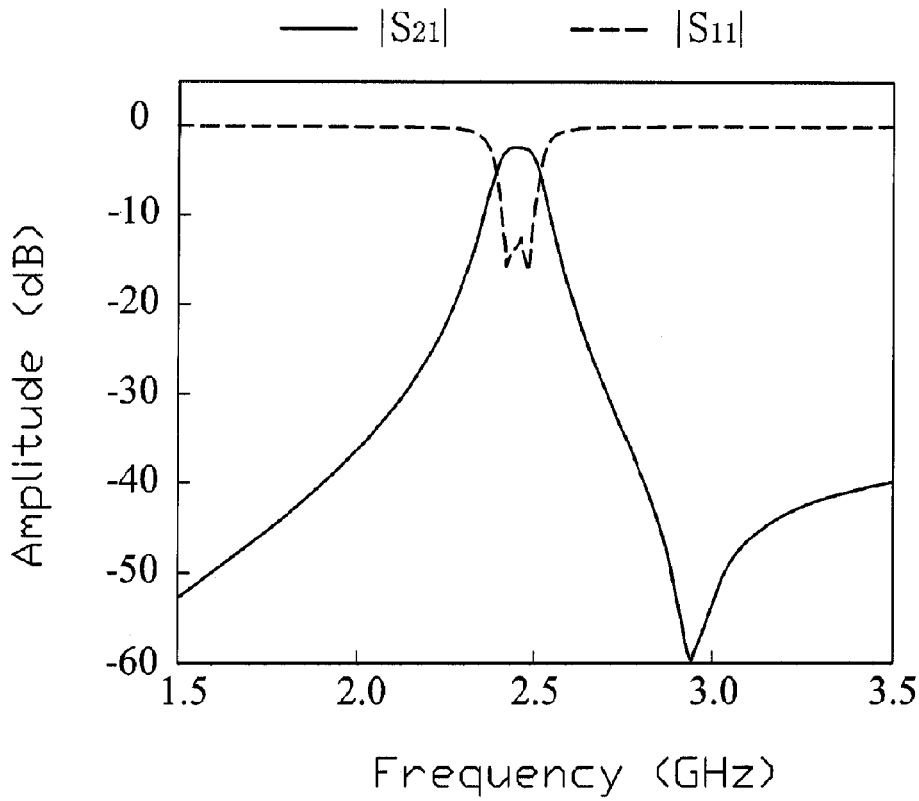
FIG. 4 is a graph of a curve showing a relationship between insertion-or-return loss and frequency of electromagnetic signals traveling through the band-pass filter.

FIG. 4 is a graph of a curve showing a relationship between insertion-or-return loss and frequency of electromagnetic signals traveling through the band-pass filter 10. The horizontal axis represents the frequency (in GHz) of electromagnetic signals traveling through the band-pass filter 10, and the vertical axis represents the insertion-or-return loss (amplitude in dB) of the band-pass filter 10. The insertion loss of an electromagnetic signal traveling through the band-pass filter 10 is indicated by the curve labeled S21 and indicates a relationship between input power and output power of the electromagnetic signals traveling through the band-pass filter 10, and is represented by the following equation:

$$\text{Insertion Loss}=-10*Lg[(\text{Input Power})/(\text{Output Power})].$$

When the electromagnetic signals travels through the band-pass filter 10, a portion of the input power is returned to a source of the electromagnetic signals. The portion of the input power returned to the source of the electromagnetic signals is called return power. The return loss of an electromagnetic signal traveling through the band-pass filter 10 is indicated by the curve labeled S11 and indicates a relationship between the input power and the return power of the electromagnetic signal traveling through the band-pass filter 10, and is represented by the following equation:

$$\text{Return Loss}=-10*Lg[(\text{Input Power})/(\text{Return Power})].$$

For a filter, when an output power of electromagnetic signals in a band-pass frequency range is close to an input power thereof, and a return power of the electromagnetic signals is small, it means that a distortion of the electromagnetic signals is small, and performance of the band-pass filter 10 is good. That is, the smaller an absolute value of the insertion loss is, the greater the absolute value of the return loss is, and the better the performance of the filter is. As shown in FIG. 4, the absolute value of the insertion loss is close to a value of 0, and the absolute value of the return loss is greater than a value of 10. The band-pass filter 10 has a good performance as a band-pass filter.

In this embodiment, the electromagnetic signals are fed into the first coupling line 180 and the second coupling line 190 for generating a larger coupling capacitance. Therefore, the transmission zero point A is close to the pass band for more effectively reducing the harmonic electromagnetic signals.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A band-pass filter comprising:

an input line for input of electromagnetic signals;

an output line for output of electromagnetic signals;

at least one first resonator comprising a first grounded end, electronically connected to the input line, and a first open end; and at least one second resonator disposed parallel to the first resonator, the second resonator comprising a second grounded end, electronically connected to the output line, and a second open end;

wherein the first grounded end is disposed in the same direction as the second grounded end, and the first open end is disposed in the same direction as the second open end.

2. The band-pass filter as recited in claim 1, wherein the output line is symmetrical to the input line.

3. The band-pass filter as recited in claim 1, wherein the input line and the output line have impedance values of approximately 50 ohms.

4. The band-pass filter as recited in claim 1, wherein the first resonator comprises a first external portion, and a first coupling portion disposed parallel thereto.

5. The band-pass filter as recited in claim 4, wherein the first resonator further comprises a first connecting portion perpendicular to the first external portion and the first coupling portion.

6. The band-pass filter as recited in claim 5, wherein the first resonator further comprises a first internal portion disposed parallel to the first external portion and the first coupling portion.

7. The band-pass filter as recited in claim 6, wherein the first resonator further comprises a second connecting portion perpendicular to the first internal portion and the first coupling portion.

8. The band-pass filter as recited in claim 6, wherein the first open end is a free end of the first internal portion, and the first grounded end is a free end of the first external portion.

9. The band-pass filter as recited in claim 4, wherein a length of the first external portion is substantially same as that of the first coupling portion.

10. The band-pass filter as recited in claim 4, wherein the input line is electronically connected to the first external portion.

11. The band-pass filter as recited in claim 1, wherein the second resonator comprises a second external portion, and a second coupling portion disposed parallel to the second external portion.

12. The band-pass filter as recited in claim 11, wherein the second resonator further comprises a third connecting portion perpendicular to the second external portion and the second coupling portion.

13. The band-pass filter as recited in claim 12, wherein the second resonator further comprises a second internal portion disposed parallel to the second external portion and the second coupling portion.

14. The band-pass filter as recited in claim 13, wherein the second resonator further comprises a fourth connecting portion perpendicular to the second internal portion and the second coupling portion.

15. The band-pass filter as recited in claim 14, wherein the second open end is a free end of the second internal portion, and the second grounded end is a free end of the second external portion.

16. The band-pass filter as recited in claim 11, wherein the length of the first external portion is substantially same as that of the first coupling portion.

17. The band-pass filter as recited in claim 11, wherein the first coupling portion is disposed in the vicinity of the second coupling portion.

18. A filter comprising:

an input line for input of electromagnetic signals into said filter;

an output line for output of said electromagnetic signals away from said filter;

a first resonator comprising a first grounded end electrically connectable with said input line to be signal communicable therewith, a first coupling portion extending from said first grounded end and electrically connectable therewith, and a first open end extending from said first coupling portion and electrically connectable therewith, said first open end extending to point along a direction opposite to said first grounded end;

a second resonator disposed next to said first resonator, and comprising a second grounded end electrically connectable with said output line to be signal communicable therewith, a second coupling portion extending from said second grounded end and electrically connectable therewith, said second coupling portion extending beside said first coupling portion of said first resonator and spaced therefrom for signal communication between said first coupling portion of said first resonator and said second coupling portion of said second resonator, a second open end extending from said second coupling portion and electrically connectable therewith, said second open end extending to point along another direction opposite to said second grounded end.

19. A filter comprising:

an input line for input of electromagnetic signals into said filter;

an output line for output of said electromagnetic signals away from said filter;

a first resonator comprising a first grounded end electrically connectable with said input line to be signal communicable therewith, a first coupling portion extending from said first grounded end and electrically connectable therewith, and a first open end extending from said first coupling portion and electrically connectable therewith, said first open end spatially arranged between said first coupling portion and said first grounded end without other electrical connection with said first open end; and a second resonator disposed next to said first resonator, and comprising a second grounded end electrically connectable with said output line to be signal communicable therewith, a second coupling portion extending from said second grounded end and electrically connectable therewith, said second coupling portion extending beside said first coupling portion of said first resonator and spaced therefrom for signal communication between said first coupling portion of said first resonator and said second coupling portion of said second resonator, a second open end extending from said second coupling portion and electrically connectable therewith, said second open end spatially arranged between said second coupling portion and said second grounded end without other connection with said second open end.

20. The filter as recited in claim 19, further comprising a third resonator spatially intervening between said first and second resonators, said third resonator configured same as a selective one of said first and second resonators.

* * * * *